US007692385B2

(12) United States Patent
Park

(10) Patent No.: US 7,692,385 B2
(45) Date of Patent: Apr. 6, 2010

(54) PLASMA DISPLAY PANEL WITH ENHANCED DISCHARGE EFFICIENCY AND LUMINANCE

(75) Inventor: Bong-Kyoung Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 739 days.

(21) Appl. No.: 11/155,274

(22) Filed: Jun. 17, 2005

(65) Prior Publication Data

US 2006/0001372 A1 Jan. 5, 2006

(30) Foreign Application Priority Data

Jun. 30, 2004 (KR) ..... 10-2004-0050609

(51) Int. Cl.
*H01J 17/49* (2006.01)
*H01J 17/00* (2006.01)

(52) U.S. Cl. ..... 313/582; 313/567; 313/583; 313/584; 313/585; 313/586; 313/581

(58) Field of Classification Search ..... None
See application file for complete search history.

(56) References Cited

U.S. PATENT DOCUMENTS 6,376,986 B1 * 4/2002 Takagi et al. ..... 313/582
6,489,722 B1 12/2002 Yoshida et al.
6,504,519 B1 * 1/2003 Ryu et al. ..... 345/60
6,628,075 B1 * 9/2003 Kim ..... 313/586
7,078,858 B2 * 7/2006 Su et al. ..... 313/582
2003/0132898 A1 * 7/2003 Akiba ..... 345/63
2004/0041522 A1 * 3/2004 Takada et al. ..... 313/586

FOREIGN PATENT DOCUMENTS

CN 1393840 A 1/2003

(Continued)

OTHER PUBLICATIONS

Korean Patent Abstracts, Publication No. 1020030059906; Publication Date: Dec. 7, 2003; in the name of Shin.

(Continued)

*Primary Examiner*—Nimeshkumar D Patel
*Assistant Examiner*—Natalie K Walford
(74) *Attorney, Agent, or Firm*—Christie, Parker & Hale, LLP

(57) ABSTRACT

A plasma display panel (PDP) that has improved discharge efficiency and luminance includes: a first substrate and a second substrate which are provided to oppose each other; barrier ribs which are provided between the first and second substrates and by which a plurality of discharge cells are partitioned; a phosphor layer formed in each of the discharge cells; address electrodes formed either on the first substrate or on the second substrate; and display electrodes formed on the first substrate to extend in a direction intersecting with the address electrodes. The display electrodes include: at least a pair of first display electrodes which are provided close to both peripheral portions of each discharge cell; and a second display electrode provided between the first display electrodes to cross the discharge cell, the second display electrode facing the first display electrodes on both sides to form at least two discharge gaps within each discharge cell.

12 Claims, 10 Drawing Sheets

FOREIGN PATENT DOCUMENTS

| | | | |
|---|---|---|---|
| CN | 1424739 | | 6/2003 |
| JP | 05-266800 | A | 10/1993 |
| JP | 08-306318 | A | 11/1996 |
| JP | 2000-323045 | A | 11/2000 |
| JP | 2002-343260 | A | 11/2002 |
| JP | 2003-068208 | A | 3/2003 |
| JP | 2003-132806 | | 5/2003 |
| JP | 2004-071219 | A | 3/2004 |
| KR | 2003-0059906 | | 7/2003 |

OTHER PUBLICATIONS

Patent Abstracts of Japan, Publication No. 2003-132806; Date of Publication: May 9, 2003; in the name of Kwang Yeol Choi.

* cited by examiner

PLASMA DISPLAY PANEL WITH ENHANCED DISCHARGE EFFICIENCY AND LUMINANCE

CROSS REFERENCE TO RELATED APPLICATION

This application claims priority to and the benefit of Korean Patent Application No. 10-2004-0050609 filed on Jun. 30, 2004 in the Korean Intellectual Property Office, the entire content of which is incorporated herein by reference.

BACKGROUND OF THE INVENTION

1. Technical Field

The present invention relates to a plasma display panel (PDP) for displaying an image by use of gas discharge.

2. Related Art

In general, a PDP is a display device in which plasma generated by gas discharge emits vacuum ultra-violet (VUV) light, the VUV light excites phosphor layers, and an image is displayed using visible light of red (R), green (G), and blue (B). The PDP with a large-sized display screen of 60 inches or more can be realized in a thickness of 10 cm or less. Since the PDP is a self-emitting display device like a cathode ray tube (CRT), it provides outstanding color reproducibility and wide viewing angle. Further, since the PDP is more advantageous than a liquid crystal display (LCD) in terms of fabrication process, productivity, and cost, it is becoming popular as a flat panel display for televisions and computers.

An alternating current (AC) PDP includes rear and front substrates. The rear substrate has address electrodes formed thereon. A dielectric layer is formed on the inner surface of the rear substrate and covers the address electrodes. Stripe-shaped barrier ribs are provided between the address electrodes on the dielectric layer. Phosphor layers of R, G, and B primary colors are provided between the barrier ribs. The front substrate which opposes the rear substrate has, on one surface, display electrodes consisting of a pair of transparent and bus electrodes formed in a direction intersecting with the address electrodes. A dielectric layer and an MgO protective film are sequentially formed on the inner surface of front substrate while covering the display electrodes. Discharge cells are formed at locations where the address electrodes on the rear substrate and the display electrodes on the front substrate intersect each other. Millions of unit discharge cells are arranged in a matrix form within the PDP. The discharge cells in AC PDP arranged in a matrix form are driven using memory characteristics.

In more detail, to generate discharge between a pair of display electrodes consisting of X- and Y-electrodes, a potential difference of a predetermined voltage or more is required, which is called a firing voltage Vf. When a scan pulse and an addressing voltage Va are applied to the Y-electrode and the address electrode, respectively, discharge is initiated between the two electrodes, whereby plasma is formed in a selected discharge cell. Electrons and ions within the plasma move to an electrode having an opposite polarity to thereby generate a current.

Each electrode of the AC PDP is covered with a dielectric layer, such that most of the space charges are accumulated on the dielectric layer having opposite polarity. Accordingly, a net space potential between the Y-electrode and the address electrode becomes smaller than the originally applied addressing voltage Va, so that discharge weakens and address discharge disappears. A relatively small amount of electrons are accumulated on the X-electrode, while a relatively large amount of ions are accumulated on the Y-electrode. The electrical charges accumulated on the dielectric layer covering the X- and Y-electrodes are referred to as wall charges Qw. The space voltage formed between the X- and Y-electrodes by the wall charges is referred to as wall voltage Vw.

When a constant sustain discharge voltage Vs is applied between the X- and Y-electrodes, for example, when a sum Vs+Vw of the sustain discharge voltage Vs and the wall voltage Vw is greater than the discharge firing voltage Vf, discharge occurs within the discharge cell. VUV light generated at this time excites phosphor layers to emit visible light through the transparent front substrate.

However, when address discharge is not generated between the Y-electrode and the address electrode (i.e. when the addressing voltage Va is not applied), wall charges are not accumulated between the X- and Y-electrodes. As such, a wall voltage is not present between the X- and Y-electrodes. In this case, only the sustain discharge voltage Vs applied between the X- and Y-electrodes is formed in the discharge cell. Since this voltage Vs is lower than the discharge firing voltage Vf, discharge does not occur in the space between the X- and Y-electrodes.

The PDP, which is driven as above, has a pair of X- and Y-electrodes within each discharge cell. Accordingly, after a reset period, address discharge occurs during an address period at a location of the discharge cell where the Y-electrode and the address electrode intersect each other. During the subsequent sustain period, sustain discharge occurs at a location of the discharge cell between the X- and Y-electrodes.

In the PDP, surface discharge occurs between the X- and Y-electrodes at the center of the discharge cell. As a result, as the distance from the center of the discharge cell increases, the density and density uniformity of plasma generating surface discharge becomes remarkably weak, thereby decreasing discharge efficiency and brightness.

SUMMARY OF THE INVENTION

In accordance with the present invention a PDP is provided that has improved discharge efficiency and brightness.

In accordance with the present invention, there is provided a PDP which includes: a first substrate and a second substrate which are provided to oppose each other; barrier ribs which are provided between the first and second substrates and by which a plurality of discharge cells are partitioned; a phosphor layer formed in each of the discharge cells; address electrodes formed either on the first substrate or on the second substrate; and display electrodes formed on the first substrate to extend in a direction intersecting with the address electrodes, the display electrodes including at least a pair of first display electrodes which are provided close to both peripheral portions of each discharge cell and a second display electrode provided between the first display electrodes to cross the discharge cell, and the second display electrode facing the first display electrodes on both sides to form at least two discharge gaps within each discharge cell.

An opposing structure in which the first and second display electrodes oppose each other on one side of the discharge cell and another opposing structure in which the first and second display electrodes oppose each other on the other side of the discharge cell may be provided symmetrically with respect to a central line in the longitudinal direction of the second display electrode.

Discharge gaps formed between the first and second display electrodes which oppose each other may include a first gap and a second gap which are different in length from each other, the first gap being greater than the second gap.

The first gap may correspond to the center of the discharge cell in a widthwise direction.

At least one of the first and second display electrodes may be formed of a bus electrode made of a metallic material.

The first display electrodes may include a first electrode member and a second electrode member which are provided to correspond to each other on both sides of each discharge cell, and the second display electrode may include a third electrode member and a fourth electrode member which oppose the first electrode member and the second electrode member, respectively to form discharge gaps.

The third and fourth electrode members may be connected to each other by a interconnecting bar at a portion corresponding to a central portion of the discharge cell.

The first and second electrode members may be short-circuited at a terminal so that the substantially same signal voltage is applied to the first and second electrode members.

The third and fourth electrode members may be short-circuited at a terminal so that the substantially same signal voltage is applied to the third and fourth electrode members.

Different signal voltages may be applied to the first and second electrode members.

Scan pulse voltages may be sequentially applied to the first display electrode during an address period.

Scan pulse voltages may be sequentially applied to the second display electrode during an address period.

The first display electrodes may include a first electrode member and a second electrode member which are provided to correspond to each other on both sides of each discharge cell, and the second display electrode may include a bus electrode and a transparent electrode which oppose the first electrode member and the second electrode member, respectively to form discharge gaps, the bus electrode passing through the center of the discharge cell and the transparent electrode extending towards the first display electrode from the bus electrode. The transparent electrode may correspond to the first display electrode to form discharge gaps.

The first and second electrode members may be short-circuited at a terminal so that the substantially same signal voltage is applied to the first and second electrode members.

Different signal voltages may be applied to the first and second electrode members.

Scan pulse voltages may be sequentially applied to the first electrode members during an address period.

According to an aspect of the present invention, the first display electrodes are formed of a first Y-electrode and a second Y-electrode which are provided to correspond to each other on both sides of each discharge cell, and the second display electrode are formed of a first X-electrode and a second X-electrode which are provided to correspond to a central portion of the discharge cell between the first Y-electrode and the second Y-electrode. Accordingly, the second display electrode is interposed between the first Y-electrode and the second Y-electrode.

The first Y-electrode and the second Y-electrode are connected to the same terminal so that the same sustain discharge voltage can be applied to the first and second Y-electrodes.

The first X-electrode and the second X-electrode are connected to the same terminal so that the same sustain discharge voltage can be applied to the first and second X-electrodes. Also, the first X-electrode and the second X-electrode are connected by a short bar formed in an extending direction of the address electrode at the center of the discharge cell.

According to another aspect of the present invention, the first display electrodes are formed of a first Y-electrode and a second Y-electrode which are provided to correspond to each other on both sides of each discharge cell, and the second display electrode is formed of an X-electrode which is provided to correspond to a central portion of the discharge cell between the first Y-electrode and the second Y-electrode. Accordingly, the second display electrode is interposed between the first Y-electrode and the second Y-electrode.

The first Y-electrode and the second Y-electrode are connected to the same terminal so that the same sustain discharge voltage can be applied to the first and second Y-electrodes.

The X-electrode consists of a bus electrode, which passes through the center of the discharge cell, and a transparent electrode, which is provided to oppose the first display electrode and expands towards the first display electrode from the bus electrode.

According to a further aspect of the present invention, the first display electrodes are formed of a first X-electrode and a second X-electrode which are provided to correspond to each other on both sides of each discharge cell, and the second display electrode is formed of a first Y-electrode and a second Y-electrode which are provided to correspond to a central portion of the discharge cell between the first X-electrode and the second X-electrode. Accordingly, the second display electrode is interposed between the first X-electrode and the second X-electrode.

The first X-electrode and the second X-electrode are connected to the same terminal so that the same sustain discharge voltage can be applied to the first and second X-electrodes.

The first Y-electrode and the second Y-electrode are connected to the same terminal so that the same sustain discharge voltage can be applied to the first and second Y-electrodes. Also, the first Y-electrode and the second Y-electrode are connected by a short bar formed in an extending direction of the address electrode at the center of the discharge cell.

According to a further aspect of the present invention, the first display electrodes are formed of a first X-electrode and a second X-electrode which are provided to correspond to each other on both sides of each discharge cell, and the second display electrode is formed of a Y-electrode which is provided to correspond to a central portion of the discharge cell between the first X-electrode and the second X-electrode. Accordingly, the second display electrode is interposed between the first X-electrode and the second X-electrode.

The first X-electrode and the second X-electrode are connected to the same terminal so that the same sustain discharge voltage can be applied to the first and second X-electrodes.

The Y-electrode consists of a bus electrode, which passes through the center of the discharge cell, and a transparent electrode, which is provided to oppose the first display electrode and expands towards the first display electrode from the bus electrode.

According to a further aspect of the present invention, the first display electrodes are formed of a first Y-electrode and a second Y-electrode which are provided to correspond to each other on both sides of each discharge cell, and the second display electrode is formed of a first X-electrode and a second X-electrode which are provided to correspond to a central portion of the discharge cell between the first Y-electrode and the second Y-electrode. Accordingly, the second display electrode is interposed between the first Y-electrode and the second Y-electrode.

The first Y-electrode and the second Y-electrode are connected to different terminals so that different signal voltages can be applied to the first and second Y-electrodes, respectively.

According to a further aspect of the present invention, the first display electrodes are formed of a first Y-electrode and a second Y-electrode which are provided to correspond to each other on both sides of each discharge cell, and the second display electrode is formed of an X-electrode which is provided to correspond to a central portion of the discharge cell between the first Y-electrode and the second Y-electrode. Accordingly, the second display electrode is interposed between the first Y-electrode and the second Y-electrode.

The first Y-electrode and the second Y-electrode are connected to different terminals so that different signal voltages can be applied to the first and second Y-electrodes, respectively.

According to a further aspect of the present invention, the first display electrodes are formed of a first X-electrode and a second X-electrode which are provided to correspond to each other on both sides of each discharge cell, and the second display electrode is formed of a first Y-electrode and a second Y-electrode which are provided to correspond to a central portion of the discharge cell between the first X-electrode and the second X-electrode. Accordingly, the second display electrode is interposed between the first X-electrode and the second X-electrode.

The first X-electrode and the second X-electrode are connected to different terminals so that different signal voltages can be applied to the first and second X-electrodes, respectively.

According to a further aspect of the present invention, the first display electrodes are formed of a first X-electrode and a second X-electrode which are provided to correspond to each other on both sides of each discharge cell, and the second display electrode is formed of a Y-electrode which is provided to correspond to a central portion of the discharge cell between the first X-electrode and the second X-electrode. Accordingly, the second display electrode is interposed between the first X-electrode and the second X-electrode.

The first X-electrode and the second X-electrode are connected to different terminals so that different signal voltages can be applied to the first and second X-electrodes, respectively.

DETAILED DESCRIPTION

Exemplary embodiments of the present invention will now be described below in more detail with reference to the accompanying drawings in which like numerals refer to like elements.

Figure 1:
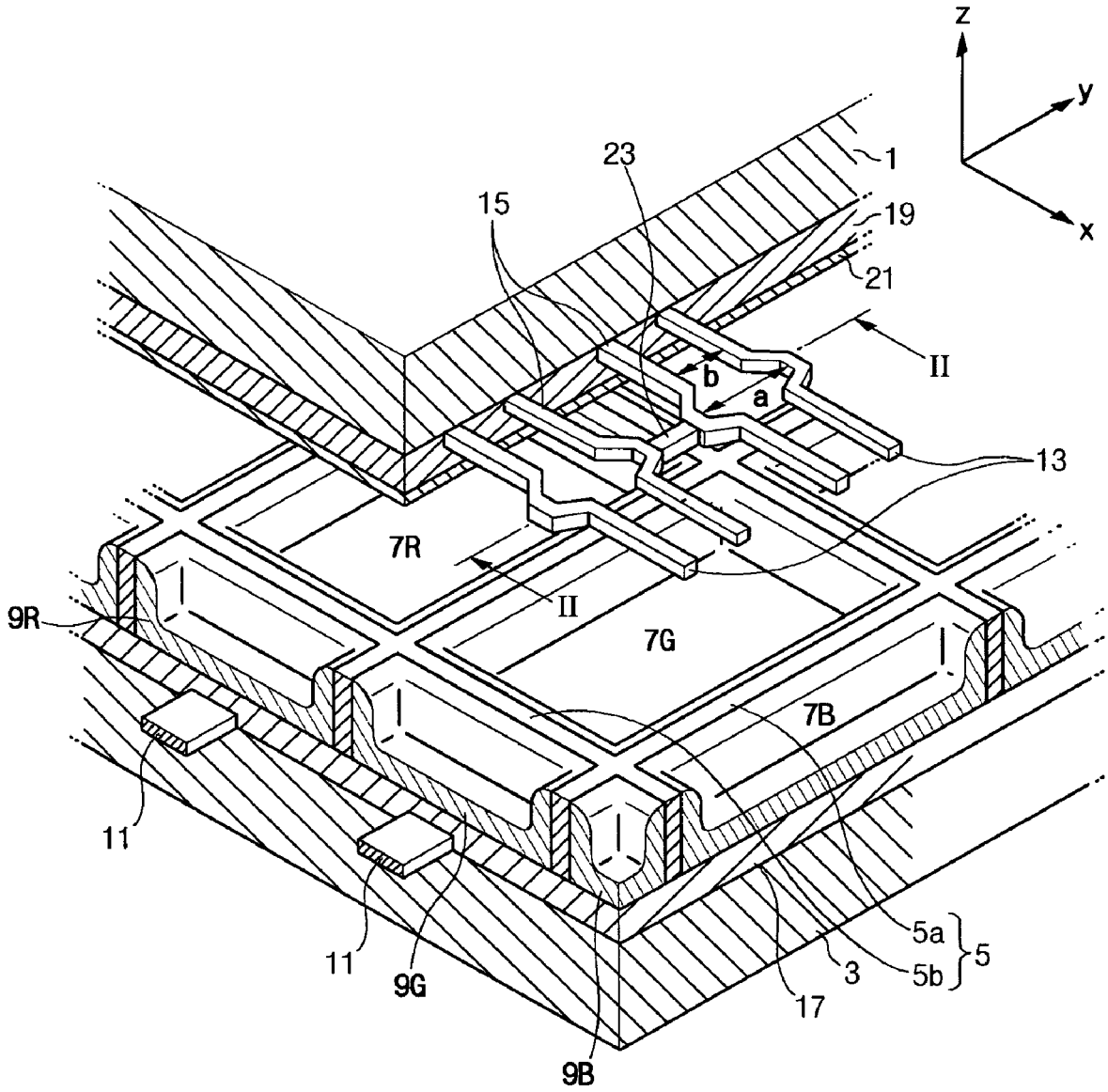
FIG. 1 is a partially exploded perspective view showing a PDP in accordance with the present invention.

Referring to FIG. 1, the PDP according to the present invention has a surface-opposing structure in which a first substrate 1 (hereinafter referred to as 'front substrate') and a second substrate 3 (hereinafter referred to as 'rear substrate') oppose each other and are bonded together. A plurality of barrier ribs 5 are arranged between the front substrate 1 and the rear substrate 3 to form a partitioned plurality of discharge cells 7R, 7G, 7B that can generate plasma discharge. The discharge cells 7R, 7G, 7B are filled with Ne—Xe gas. Phosphor layers 9R, 9G, 9B are formed by phosphor materials of R, G, and B primary colors on inner walls of respective discharge cells 7R, 7G, 7B.

Address electrodes 11 are formed extending along the y-axis direction on the rear substrate 3, and are arranged at intervals corresponding to the discharge cells 7R, 7G, 7B in the x-axis direction. Although the address electrodes 11 are provided on the rear substrate 3 in the present embodiment, the address electrodes 11 may be provided on the front substrate 1 or the barrier ribs 5. Display electrodes 13, 15 are formed on the front substrate 1 to extend in the direction intersecting with the address electrodes 11, i.e. in x-axis direction of FIG. 1. The adjacent display electrodes 13, 15 are provided at intervals corresponding to the discharge cells 7R, 7G, 7B in the y-axis direction.

The barrier ribs 5 provided between the front substrate 1 and the rear substrate 3 include a first barrier rib member 5*a* and a second barrier rib member 5*b* forming closed discharge cells 7R, 7G, 7B. The first barrier rib member 5*a* is formed to extend in the y-axis direction and provided parallel to other neighboring first barrier rib members 5*a*. The second barrier rib member 5*b* is formed to extend in the x-axis direction to intersect with the first barrier rib member 5*a* and provided parallel to other neighboring second barrier rib members 5*b*. The closed and partitioned discharge cells 7R, 7G, 7B required for plasma discharge are formed by the first and second barrier rib members 5*a* and 5*b*.

Although the present embodiment exemplifies a closed barrier rib structure in which the discharge cells 7R, 7G, 7B are formed by intersecting the first and second barrier rib members 5*a* and 5*b* extending in the y-axis and x-axis directions to each other, the present invention can be applied to a stripe-shaped barrier rib structure in which only the first barrier rib member 5*a* is present, that is, there is no second barrier rib member 5*b*. Further, in a case of using the first and second barrier rib members 5*a* and 5*b*, the discharge cells 7R, 7G, 7B may be formed in various shapes, such as octagon or hexagon, depending on the shape of the first barrier rib member 5*a*.

Figure 2:
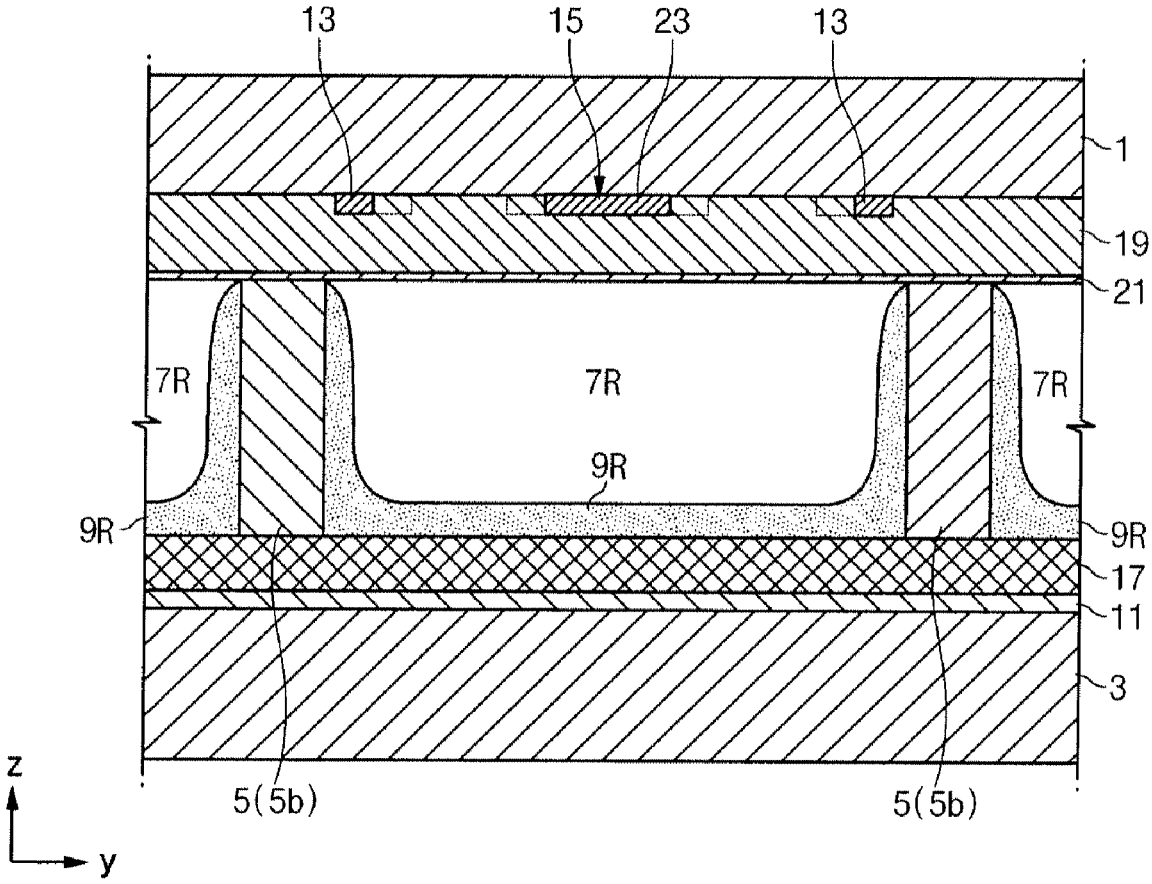
FIG. 2 is a cross-sectional view taken along the line II-II of FIG. 1.

FIG. 2 is a cross-sectional view taken along the line II-II of FIG. 1. The address electrodes 11 are covered with a first dielectric layer 17 so that wall charges are formed in the discharge cells 7R, 7G, 7B to thereby generate address discharge. In an exemplary embodiment the first dielectric layer 17 is formed of a white dielectric material to ensure reflectance of visible light.

The display electrodes 13, 15 are provided in the direction intersecting with the address electrodes 11. The display electrodes 13, 15 consist of a first display electrode 13 and a second display electrode 15 which oppose each other in the discharge cells 7R, 7G, 7B, and are covered with the dielectric layer 19 and the MgO protective film 21. Accordingly, the display electrodes 13, 15 generate address discharge together with the address electrode 11, and then generate sustain discharge at two locations of each discharge cell 7R, 7G, 7B.

Figure 3:
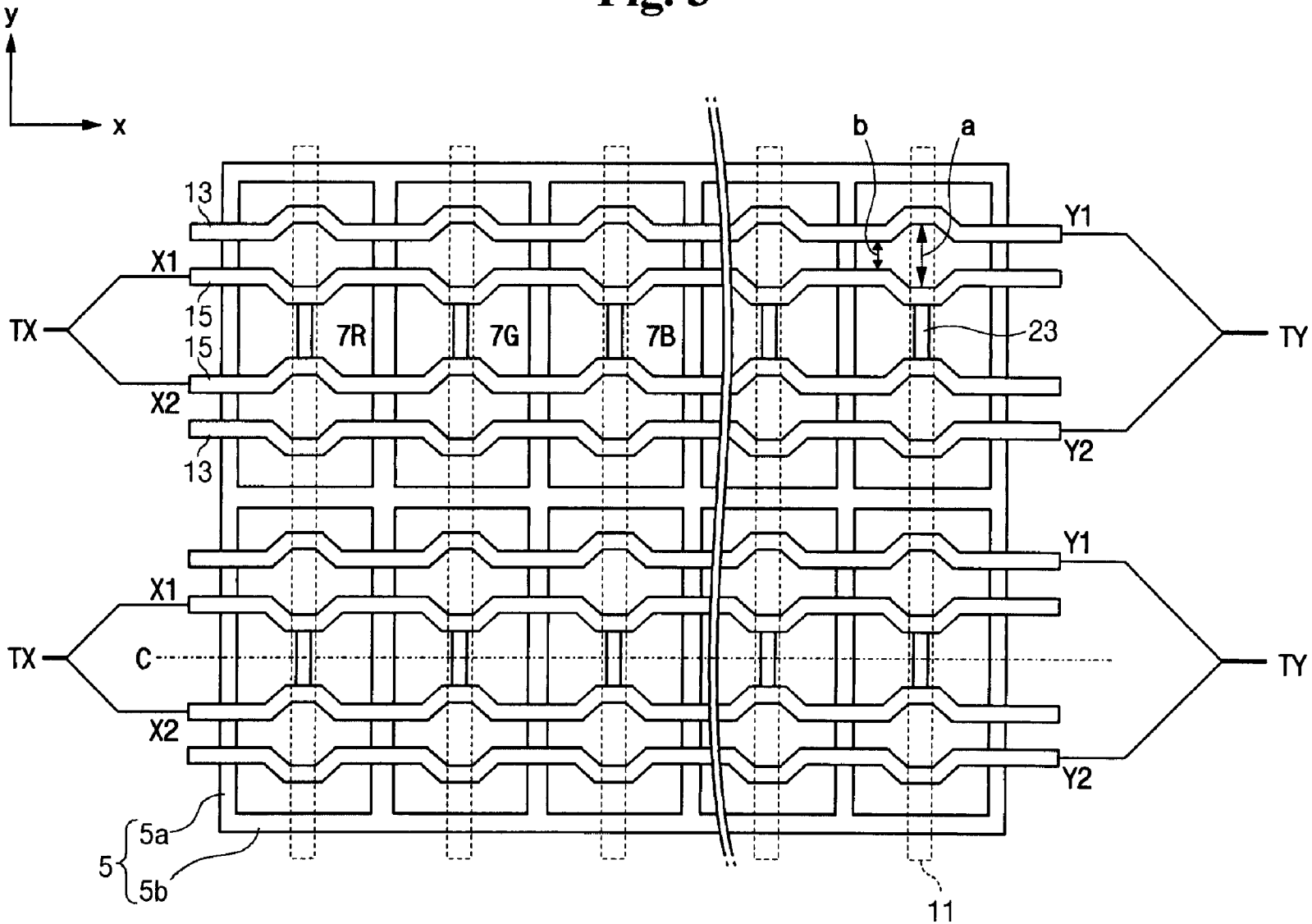
FIG. 3 is a partial plan view showing a PDP in accordance with a first embodiment of the present invention.

FIG. 3 is a partial plan view showing a PDP in accordance with a first embodiment of the present invention. The first display electrodes 13 are provided to intersect with the address electrodes 11 on both sides of the discharge cells 7R, 7G, 7B in the extending direction (y-axis direction) of the address electrode 11. The second display electrodes 15 are provided between the first display electrodes 13 to correspond to the first display electrodes 13. That is, a pair of first display electrodes 13 are provided on both sides of the discharge cells 7R, 7G, 7B in the y-axis direction, and the second display electrodes 15 are provided between the first display electrodes 13 in parallel to the first display electrodes 13. Thus, the pair of first display electrodes 13 may be referred to as first and second peripheral display electrodes while the second display electrodes 15 may be referred to as interior display electrodes.

Accordingly, in case of address discharge, the address electrode 11 to which addressing voltage is applied and the first display electrode 13 to which a scan pulse is applied oppose each other at two locations of a single discharge cell 7R, 7G, 7B. Thus, address discharge occurs at two locations of a single discharge cell 7R, 7G, 7B or two times, thereby facilitating address discharge.

In addition, the first display electrode 13 and the second display electrode 15 in an exemplary embodiment are symmetrically provided in the discharge cells 7R, 7G, 7B. That is, in an exemplary embodiment an opposing structure of the first and second electrodes 13 and 15 formed on one side of the discharge cell 7R, 7G, 7B is provided symmetrically to an opposing structure of the first and second electrodes 13 and 15 formed on the other side of the discharge cell 7R, 7G, 7B. In more detail, the first display electrodes 13 and the second display electrode 15 are provided symmetrically to each other with respect to a virtual central line C (x-axis direction) in an extending direction (x-axis direction) of the second display electrodes 15. Accordingly, since address discharge and sustain discharge occur at both locations separated from the central line C by equal distance in each discharge cell 7R, 7G, 7B, the plasma density is increased and the uniformity of plasma density is improved, compared to a structure where discharge occurs at a single location of the discharge cell 7R, 7G, 7B.

In addition, a first gap (a) and a second gap (b) are formed at locations where the first and second display electrodes 13 and 15 correspond to each other. The first gap (a) is longer than the second gap (b). That is, the first gap (a) corresponds to the center of the discharge cell 7R, 7G, 7B, while the second gap (b) corresponds to both sides of the first gap (a). As the address electrode 11 is formed to extend in the y-axis direction at the center of each discharge cell 7R, 7G, 7B, the first gap (a) corresponding to a central portion of the discharge cell 7R, 7G, 7B is longer than the second gap (b) corresponding to both sides of the first gap (a). A relatively longer gap of the first gap (a) compared to the second gap (b) causes plasma to diffuse on both sides of the long gap, resulting in maximization of the plasma density. Accordingly, the phosphor layer 9R, 9G, 9B formed on both sides of the discharge cell 7R, 7G, 7B is excited more effectively and the efficiency of visible light emission is improved.

The first display electrodes 13 thus constructed are separately formed on both sides of each discharge cell 7R, 7G, 7B, and the second display electrode 15 is integrally formed in the center of each discharge cell 7R, 7G, 7B.

Since the first display electrodes 13 are provided on both sides of the discharge cells 7R, 7G, 7B, the first display electrode in an exemplary embodiment 13 is formed of a bus electrode made of a metallic material, such as aluminum, with an excellent electrical conductivity so that a scan pulse and a sustain discharge voltage are applied while minimizing blockage of visible light. Since the second display electrodes 15 are provided in the center of the discharge cell 7R, 7G, 7B, the second display electrodes 15 in an exemplary embodiment are formed in a structure in which blockage of visible light can be minimized. For example, the second electrodes 15 may be formed of the same bus electrodes as the first display electrodes 13, or may be formed of the bus electrodes and transparent electrodes. The transparent electrode in an exemplary embodiment is formed of a transparent Indium Tin Oxide (ITO) to ensure brightness. The bus electrodes of the first display electrode 13 are formed extending on both sides of the discharge cell 7R, 7G, 7B. The bus electrode of the second display electrode 15 is formed extending to the center of the discharge cell 7R, 7G, 7B. The transparent electrode of the second electrode 15 is formed to correspond to the first display electrode 13 and expands towards the first display electrode 13 from the bus electrode.

In the PDP, a single frame is divided into a plurality of sub-fields and then driven. Each sub-field consists of a reset period, an address period, and a sustain period.

Suitable voltages are applied to the first and second display electrodes 13 and 15 to drive the PDP, together with the address electrode 11, during the reset period, address period, and sustain period. The first display electrodes 13 consist of first and second electrode members, and the second display electrodes 15 are integrally formed or consist of third and fourth electrode members.

The first and second electrode members consist of first and second Y-electrodes (Y1, Y2) in the first, second, fifth, and sixth embodiments (see FIGS. 3, 4, 7, and 8). The first and second electrode members consist of first and second X-electrodes (X1, X2) in the third, fourth, seventh, and eighth embodiments (see FIGS. 5, 6, 9, and 10). The third and fourth electrode members consist of first and second X-electrodes (X1, X2) in the first and fifth embodiments (see FIGS. 3 and 7). The first and second electrode members consist of first and second Y-electrodes (Y1, Y2) in the third and seventh embodiments (see FIGS. 5 and 9). In addition, the second display electrode 15 consists of an integral X-electrode in the second and sixth embodiments (see FIGS. 4 and 8), and consists of an integral Y-electrode in the fourth and eighth embodiments (see FIGS. 6 and 10).

That is, the first display electrode 13 is selectively used as an X- or Y-electrode. The X-electrode of the first display electrode 13 is used as the first X-electrode X1 and the second X-electrode X2. The Y-electrode of the first display electrode 13 may be used as the first Y-electrode Y1 and the second Y-electrode Y2. Also, the second display electrode 15 is selectively used as either the X- or Y-electrode. The X-electrode of the second display electrode 15 is used as the first X-electrode X1 and the second X-electrode X2. The Y-electrode of the second display electrode 15 may be used as the first Y-electrode Y1 and the second Y-electrode Y2.

The first and second display electrodes 13, 15 can be implemented in various embodiments. The first embodiment is now set forth with reference to FIG. 3.

According to the first embodiment, the first display electrodes 13 consist of the first and second electrode members, i.e. the first Y-electrode Y1 and the second Y-electrode Y2, which are provided on both sides of each discharge cell 7R, 7G, 7B. The second display electrodes 15 consist of the third and fourth electrode members, i.e. the first X-electrode X1 and the second X-electrode X2, which are provided to correspond to a central portion of the discharge cell 7R, 7G, 7B between the first Y-electrode Y1 and the second Y-electrode Y2. Thus, the third and fourth electrode members of each of the second display electrodes 15 may also be referred to as first and second interior display electrode members. Accordingly, the second display electrodes 15 oppose the first Y-electrode Y1 and the second Y-electrode Y2, and discharge gaps are formed on both sides of the second display electrode 15.

The first Y-electrode Y1 and the second Y-electrode Y2 are connected to the same terminal TY. Thus, the same signal voltage is simultaneously applied to the first Y-electrode Y1 and the second Y-electrode Y2. Reset discharge, address discharge, and sustain discharge are simultaneously generated on the discharge gaps of the discharge cell 7R, 7G, 7B during the reset period, address period, and sustain period.

Also, the first X-electrode X1 and the second X-electrode X2 are connected to the same terminal TX. The first X-electrode X1 and second X-electrode X2 are connected by a short bar 23 formed in an extending direction of the address electrode 11 in the center of the discharge cell 7R, 7G, 7B. Thus, the same voltage is simultaneously applied to the first X-electrode X1 and the second X-electrode X2, and the above-mentioned discharges occur simultaneously between the first X-electrode X1 and the first Y-electrode Y1, and between the second X-electrode X2 and the second Y-electrode Y2.

Figure 4:
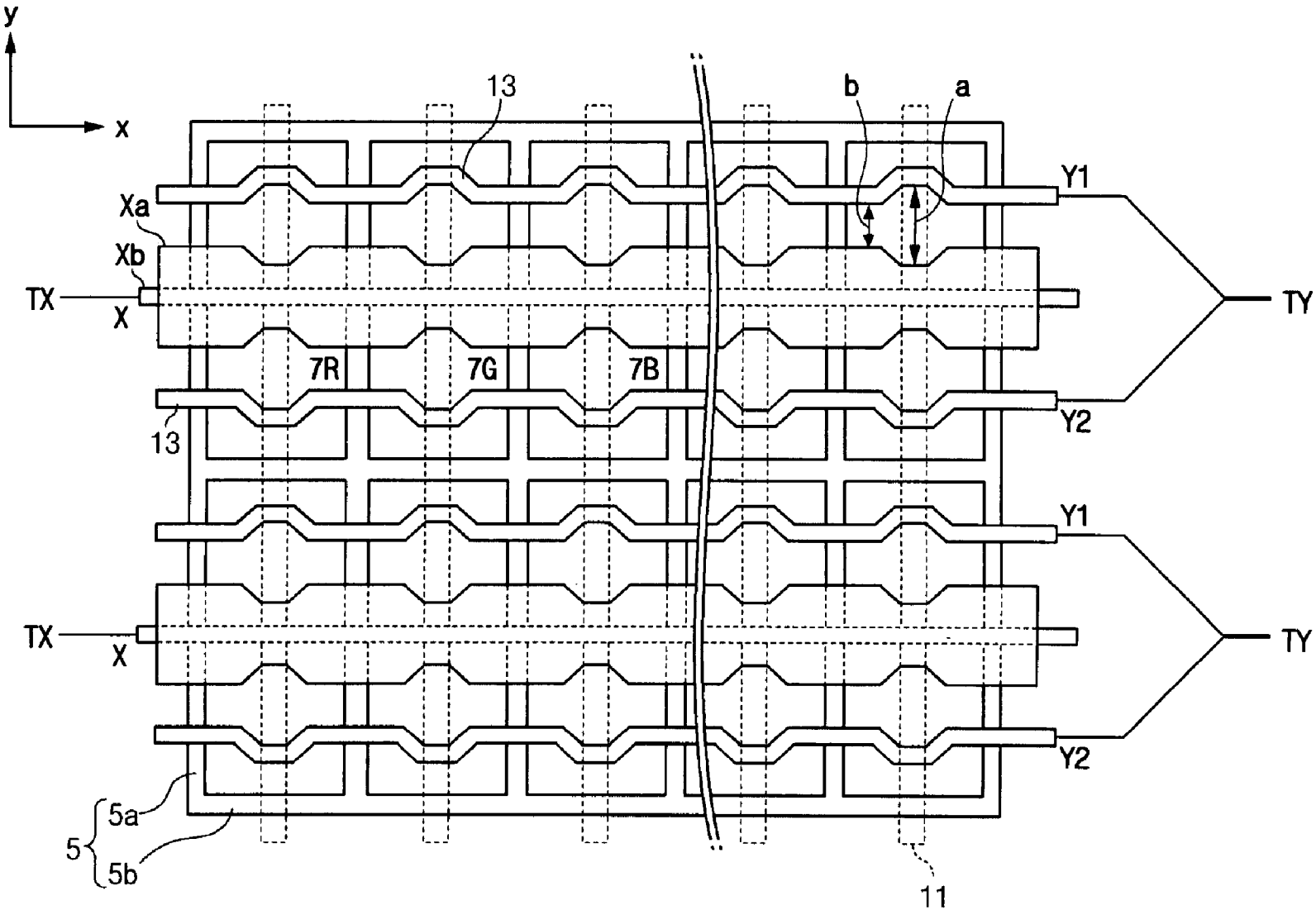
FIG. 4 is a partial plan view showing a PDP in accordance with a second embodiment of the present invention.

FIG. 4 is a partial plan view showing a PDP in accordance with a second embodiment of the present invention. The second embodiment is similar in the overall construction to the first embodiment and a detailed description of the different parts between the first and second embodiments will thus be given. Here, the first and second electrodes indicate the first Y-electrode Y1 and the second Y-electrode Y2, respectively.

According to the second embodiment, the second display electrodes 15 are formed of X-electrodes X corresponding to a central portion of the discharge cell 7R, 7G, 7B between the first Y-electrode Y1 and the second Y-electrode Y2. Thus, the X-electrode X is formed to be interposed between the first Y-electrode Y1 and the second Y-electrode Y2.

The X-electrode X is formed of a bus electrode Xb, which passes through the center of the discharge cell 7R, 7G, 7B, and a transparent electrode Xa, which is formed to correspond to the first display electrode 13 and expands towards the first display electrode 13 from the bus electrode Xb. That is, both sides of the transparent electrode Xa corresponding to the first display electrode 13 in an exemplary embodiment are formed in the same shape as both corresponding sides of the first and second X-electrodes X1 and X2 of the first embodiment. The transparent electrode Xa enhances the aperture ratio of the discharge cell 7R, 7G, 7B and thus improves brightness.

Figure 5:
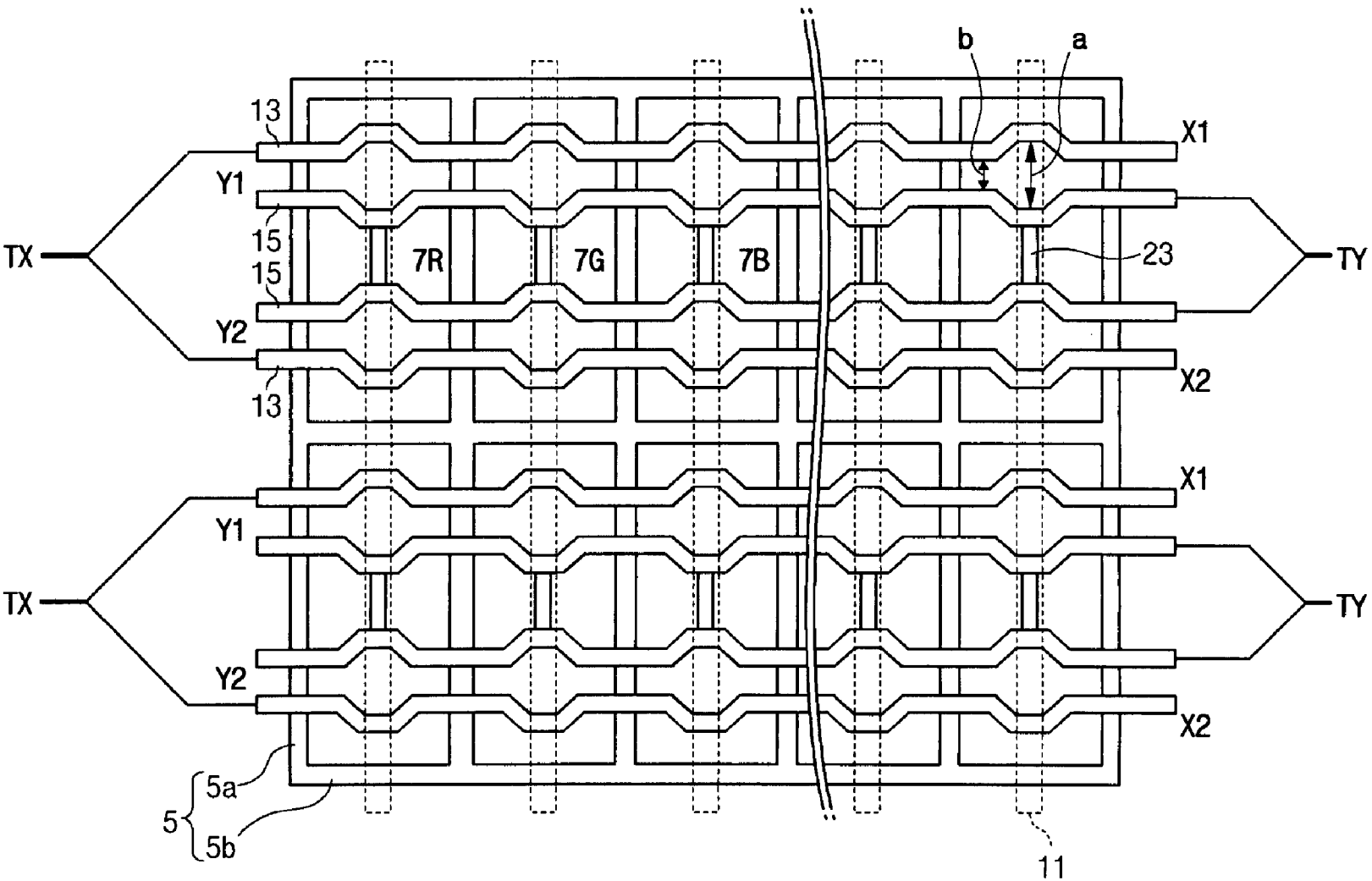
FIG. 5 is a partial plan view showing a PDP in accordance with a third embodiment of the present invention.

FIG. 5 is a partial plan view showing a PDP in accordance with a third embodiment of the present invention. The third embodiment is similar in the overall construction to the first embodiment and a detailed description of the different parts between the first and third embodiments will thus be given. Here, the first and second electrodes indicate the first X-electrode X1 and the second X-electrode X2, respectively, and the third and fourth electrodes indicate the first Y-electrode Y1 and the second Y-electrode Y2, respectively.

According to the third embodiment, the first display electrodes 13 are formed of the first X-electrode X1 and the second X-electrode X2, which are provided to correspond to each other on both sides of each discharge cell 7R, 7G, 7B. The second display electrodes 15 are formed of the first Y-electrode Y1 and the second Y-electrode Y2, which are provided to correspond to each other in a central portion of the discharge cell 7R, 7G, 7B between the first X-electrode X1 and the second X-electrode X2. Accordingly, the second display electrode 15 is formed to be interposed between the first X-electrode X1 and the second X-electrode X2. The first X-electrode X1 and the second X-electrode X2 are connected to the same terminal TX. Accordingly, the same voltage is simultaneously applied to the first X-electrode X1 and the second X-electrode X2. Reset discharge, address discharge, and sustain discharge are simultaneously generated on both sides of the discharge cell 7R, 7G, 7B during the reset period, address period, and sustain period.

Also, the first Y-electrode Y1 and the second Y-electrode Y2 are connected to the same terminal TY. The first Y-electrode Y1 and second Y-electrode Y2 are connected to a short bar 23 formed in an extending direction of the address electrode 11 in the center of the discharge cell 7R, 7G, 7B. Thus, the same voltage is simultaneously applied to the first Y-electrode Y1 and the second Y-electrode Y2, and the above-mentioned discharges occur simultaneously between the first Y-electrode Y1 and the first X-electrode X1, and between the second Y-electrode Y2 and the second X-electrode X2.

Comparing the third embodiment to the first embodiment, the first display electrodes 13 and the second display electrodes 15 are interchanged with each other. Accordingly, voltages applied to the first display electrode 13 and the second display electrode 15 in the third embodiment are the same as voltages applied to the second display electrode 15 and the first display electrode 13 in the first embodiment.

Figure 6:
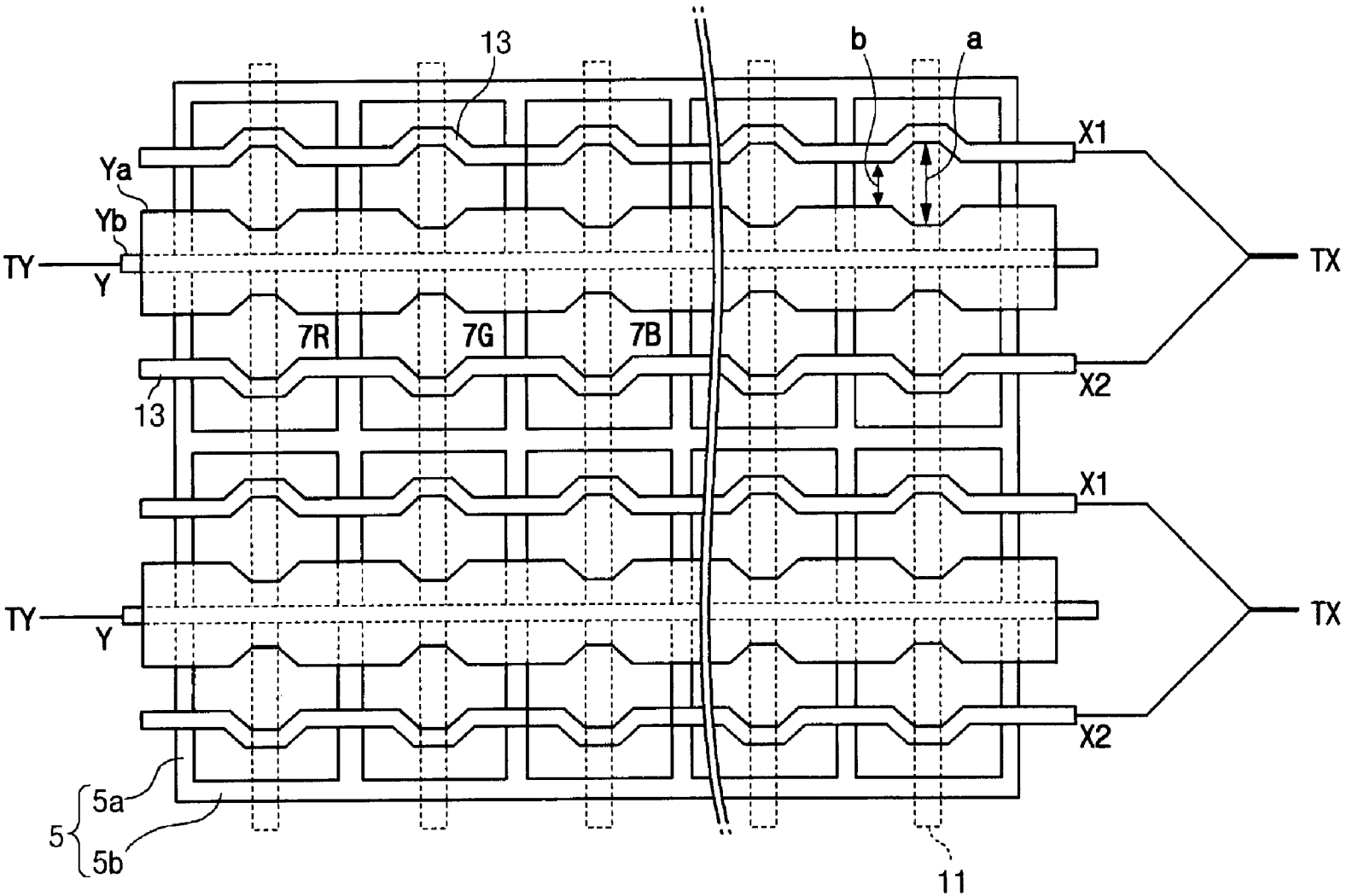
FIG. 6 is a partial plan view showing a PDP in accordance with a fourth embodiment of the present invention.

FIG. 6 is a partial plan view showing a PDP in accordance with a fourth embodiment of the present invention. The fourth embodiment is similar in the overall construction to the third embodiment and a detailed description of the different parts between the third and fourth embodiments will thus be given. Here, the first and second electrodes indicate the first X-electrode X1 and the second X-electrode X2, respectively.

According to the fourth embodiment, the second display electrodes 15 are formed of Y-electrodes Y corresponding to a central portion of the discharge cell 7R, 7G, 7B between the first X-electrode X1 and the second X-electrode X2. Thus, the Y-electrode Y is formed to be interposed between the first X-electrode X1 and the second X-electrode X2.

The Y-electrode Y is formed of a bus electrode Yb, which passes through the center of the discharge cell 7R, 7G, 7B, and a transparent electrode Ya, which is formed to correspond to the first display electrode 13 and expands towards the first display electrode 13 from the bus electrode Yb. That is, both sides of the transparent electrode Ya corresponding to the first display electrode 13 in an exemplary embodiment are formed in the same shape as both corresponding sides of the first and second Y-electrodes Y1 and Y2 of the third embodiment. The transparent electrode Ya enhances the aperture ratio of the discharge cell 7R, 7G, 7B and thus improves luminance.

Figure 7:
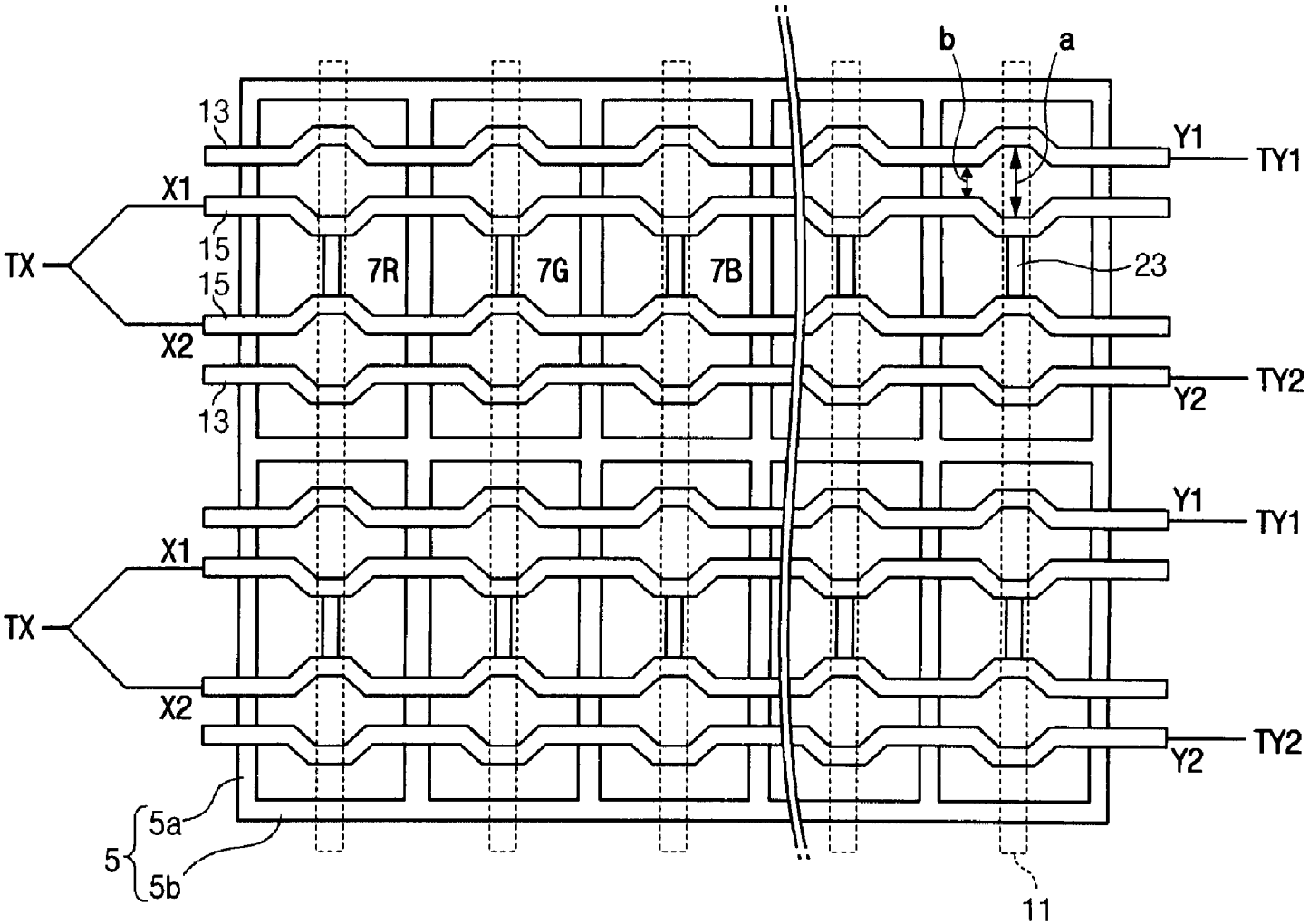
FIG. 7 is a partial plan view showing a PDP in accordance with a fifth embodiment of the present invention.

FIG. 7 is a partial plan view showing a PDP in accordance with a fifth embodiment of the present invention. The fifth embodiment is similar in the overall construction to the first embodiment and a detailed description of the different parts between the first and fifth embodiments will thus be given. Here, the first and second electrodes indicate the first Y-electrode Y1 and the second Y-electrode Y2, respectively, and the third and fourth electrodes indicate the first X-electrode X1 and the second X-electrode X2, respectively.

According to the fifth embodiment, the first display electrodes 13 are formed of the first Y-electrode Y1 and the second Y-electrode Y2, which are provided to correspond to each other on both sides of each discharge cell 7R, 7G, 7B. The first Y-electrode Y1 and the second Y-electrode Y2 are connected to different terminals TY1 and TY2, respectively. Accordingly, different signal voltages may be applied to the first Y-electrode Y1 and the second Y-electrode Y2 simultaneously or during different periods (in a sequential manner). Also, reset discharge, address discharge, and sustain discharge may occur differently on both sides of the discharge cell 7R, 7G, 7B during the reset period, address period, and sustain period.

Figure 8:
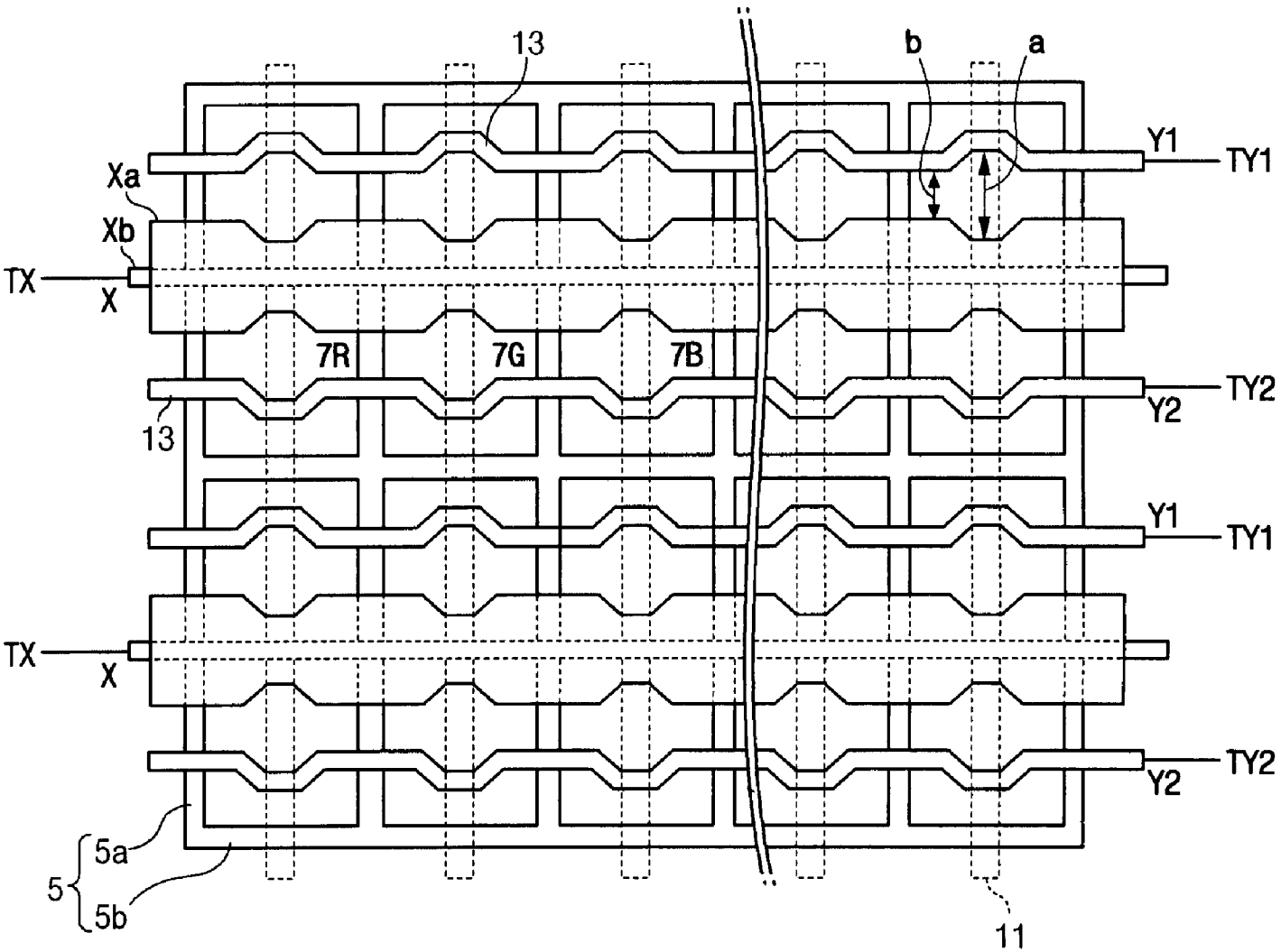
FIG. 8 is a partial plan view showing a PDP in accordance with a sixth embodiment of the present invention.

FIG. 8 is a partial plan view showing a PDP in accordance with a sixth embodiment of the present invention. The sixth embodiment is similar in the overall construction to the second embodiment and a detailed description of the different parts between the second and sixth embodiments will thus be given. Here, the first and second electrodes indicate the first Y-electrode Y1 and the second Y-electrode Y2, respectively.

According to the sixth embodiment, the first display electrodes 13 are formed of the first Y-electrode Y1 and the second Y-electrode Y2, which are provided to correspond to each other on both sides of each discharge cell 7R, 7G, 7B. The first Y-electrode Y1 and the second Y-electrode Y2 are connected to different terminals TY1 and TY2, respectively. Accordingly, as in the fifth embodiment, different signal voltages may be applied to the first Y-electrode Y1 and the second Y-electrode Y2 simultaneously or during different periods (in a sequential manner). Also, reset discharge, address discharge, and sustain discharge may occur differently on both sides of the discharge cell 7R, 7G, 7B during the reset period, address period, and sustain period.

Figure 9:
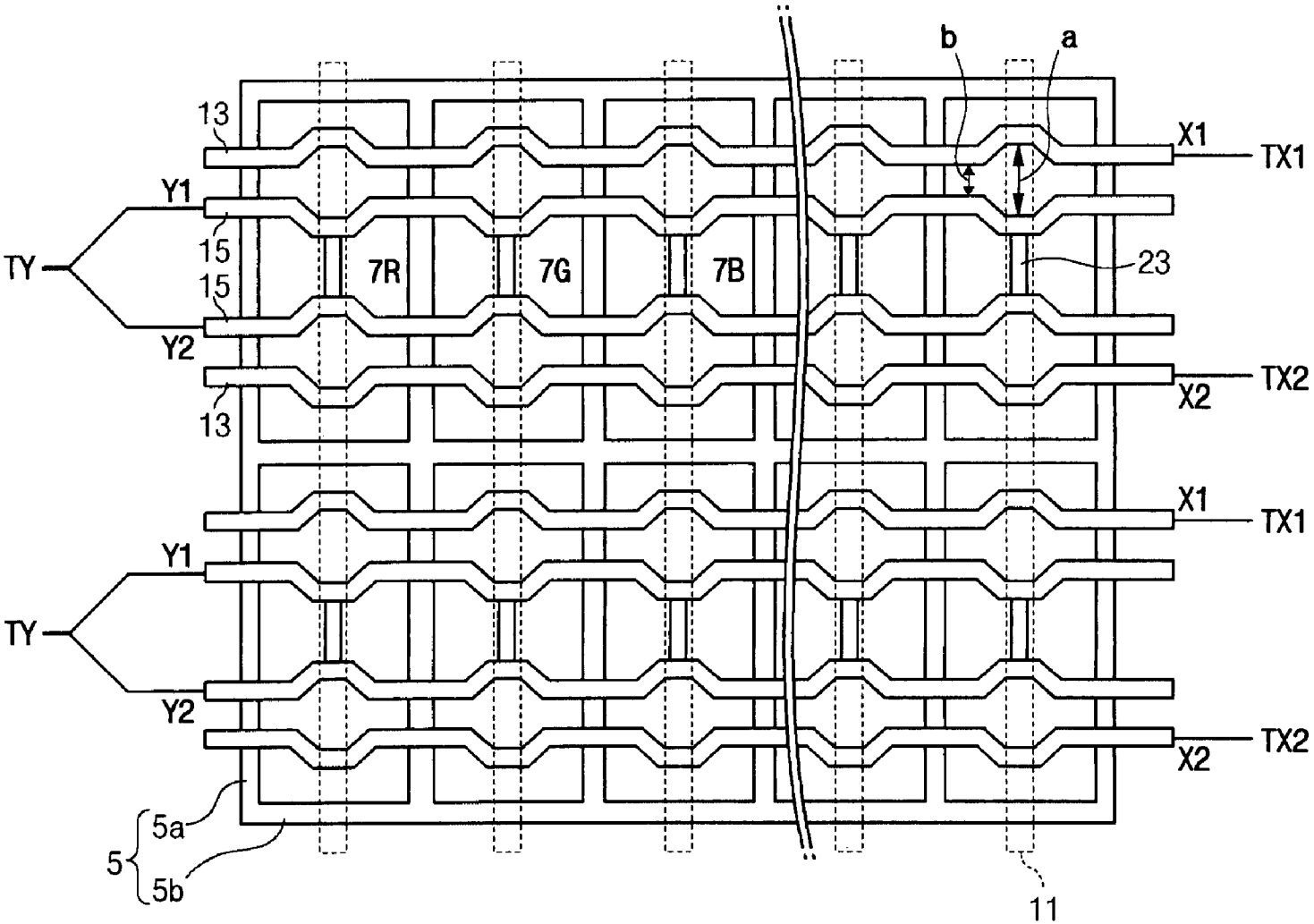
FIG. 9 is a partial plan view showing a PDP in accordance with a seventh embodiment of the present invention.

FIG. 9 is a partial plan view showing a PDP in accordance with a seventh embodiment of the present invention. The seventh embodiment is similar in the overall construction to the third embodiment and a detailed description of the different parts between the third and seventh embodiments will thus be given. Here, the first and second electrodes indicate the first X-electrode X1 and the second X-electrode X2, respectively, and the third and fourth electrodes indicate the first Y-electrode Y1 and the second Y-electrode Y2, respectively.

According to the seventh embodiment, the first display electrodes 13 are formed of the first X-electrode X1 and the second X-electrode X2, which are provided to correspond to each other on both sides of each discharge cell 7R, 7G, 7B. The first X-electrode X1 and the second X-electrode X2 are connected to different terminals TX1 and TX2, respectively.

Figure 10:
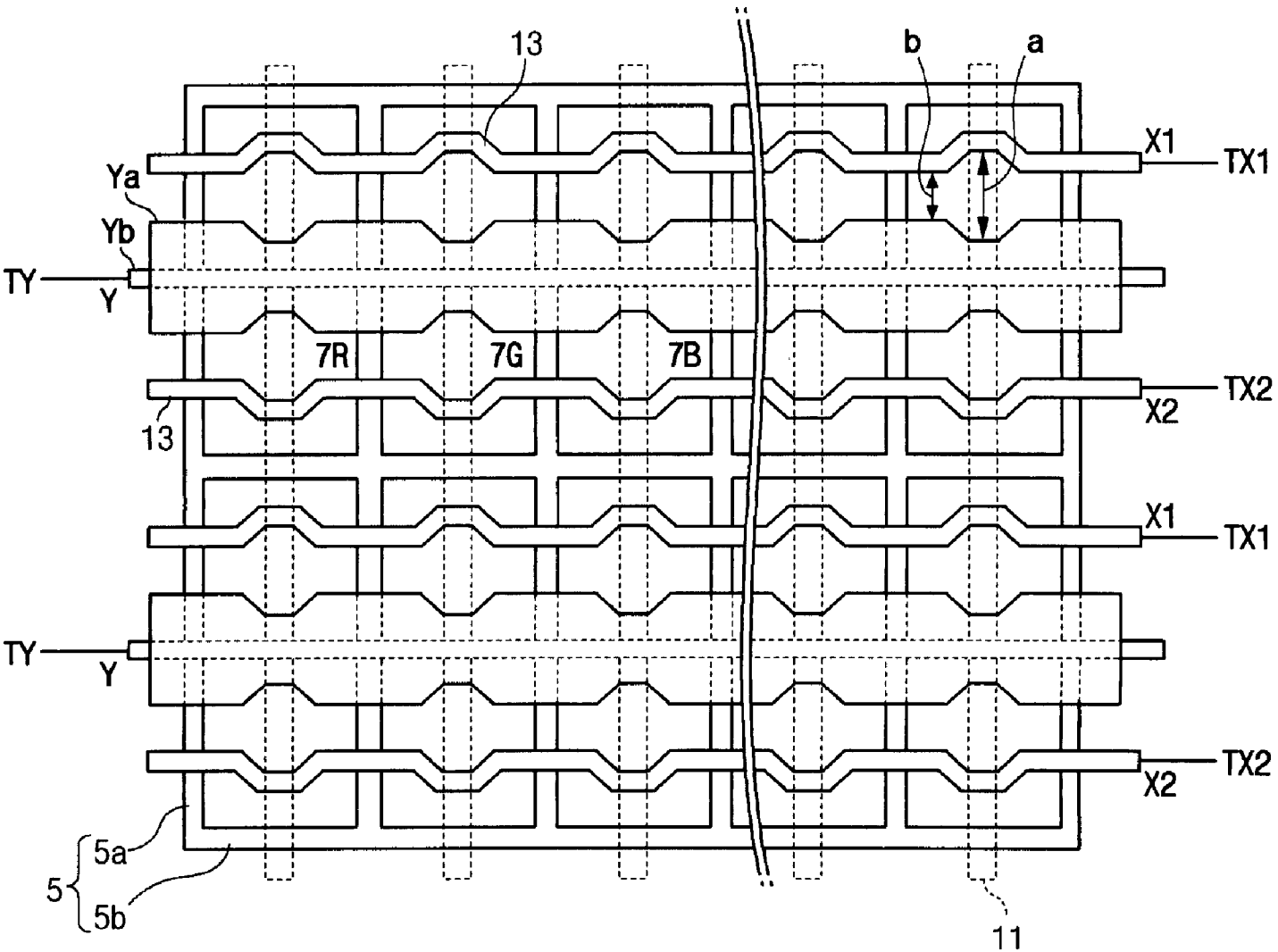
FIG. 10 is a partial plan view showing a PDP in accordance with an eighth embodiment of the present invention.

FIG. 10 is a partial plan view showing a PDP in accordance with an eighth embodiment of the present invention. The eighth embodiment is similar in the overall construction to the fourth embodiment and a detailed description of the different parts between the fourth and eighth embodiments will thus be given. Here, the first and second electrodes indicate the first X-electrode X1 and the second X-electrode X2, respectively.

According to the eighth embodiment, the first display electrodes 13 are formed of the first X-electrode X1 and the second X-electrode X2, which are provided to correspond to each other on both sides of each discharge cell 7R, 7G, 7B. The first X-electrode X1 and the second X-electrode X2 are connected to different terminals TX1 and TX2, respectively.

As apparent from the above description, since the display electrodes includes first and second display electrodes and the first and second display electrodes are formed of the X-electrode and the Y-electrode in various manners, address discharge and sustain discharge occur on both sides of each discharge cell, thereby enhancing discharge efficiency and luminance.

While the present invention has been described with reference to exemplary embodiments thereof, it will be understood by those skilled in the art that various changes in form and details may be made therein without departing from the scope of the present invention as defined by the following claims.

What is claimed is:

1. A plasma display panel comprising:

a first substrate and a second substrate opposing each other;

barrier ribs between the first substrate and the second substrate and forming a plurality of discharge cells;

a phosphor layer on each of the discharge cells;

address electrodes either on the first substrate or on the second substrate; and display electrodes on the first substrate extending in a direction intersecting with a direction of the address electrodes, the display electrodes including:

a first peripheral display electrode and a second peripheral display electrode, the first peripheral display electrode and the second peripheral display electrode being close to respective opposing peripheral portions of a corresponding one of the discharge cells; and a pair of interior display electrodes between the first peripheral display electrode and the second peripheral display electrode, the pair of interior display electrodes comprising a first interior display electrode and a second interior display electrode, the first and second interior display electrodes connected to each other through a short bar located at a center of the corresponding one of the discharge cells, the interior display electrodes opposing the first peripheral display electrode and the second peripheral display electrode to form a first sustain discharge gap between the first peripheral display electrode and the first interior display electrode, and a second sustain discharge gap between the second peripheral display electrode and the second interior display electrode.

2. The plasma display panel according to claim 1, wherein an opposing structure in which the first peripheral display electrode and the first interior display electrode oppose each other on one side of the corresponding one of the discharge cells and another opposing structure in which the second peripheral display electrode and the second interior display electrode oppose each other on an other side of the corresponding one of the discharge cells are symmetrical with respect to a central line in a longitudinal direction of the interior display electrode.

3. The plasma display panel according to claim 1, wherein at least one of the first sustain discharge gap or the second sustain discharge gap varies in width between a first gap width and a second gap width, the first gap width being greater than the second gap width.

4. The plasma display panel according to claim 3, wherein the at least one of the first sustain discharge gap or the second sustain discharge gap has a width equal to the first gap width at a location that corresponds to a center of the corresponding one of the discharge cells in a widthwise direction.

5. The plasma display panel according to claim 1, wherein the first peripheral display electrode and the second peripheral display electrode are bus electrodes of a metallic material.

6. The plasma display panel according to claim 1, wherein a shape of the first peripheral display electrode and a shape of the second peripheral display electrode correspond to each other on respective sides of the corresponding one of the discharge cells.

7. The plasma display panel according to claim 6, wherein the first peripheral display electrode and the second peripheral display electrode are short-circuited at a terminal so that a substantially same signal voltage is applied to the first peripheral display electrode and the second peripheral display electrode,

8. The plasma display panel according to claim 7, wherein the first interior display electrode and the second interior display electrode are short-circuited at a terminal so that a substantially same signal voltage is applied to the first interior display electrode and the second interior display electrode.

9. The plasma display panel according to claim 6, wherein the first interior display electrode and the second interior display electrode are short-circuited at a terminal so that a substantially same signal voltage is applied to the first interior display electrode and the second interior display electrode.

10. The plasma display panel according to claim 6, wherein different signal voltages are applied to the first peripheral display electrode and the second peripheral display electrode.

11. The plasma display panel according to claim 6, wherein scan pulse voltages are sequentially applied to the first peripheral display electrode and the second peripheral display electrode during an address period.

12. The plasma display panel according to claim 6, wherein scan pulse voltages are sequentially applied to the first interior display electrode and the second interior display electrode during an address period.

* * * * *